US012698930B2

(12) United States Patent
Gale

(10) Patent No.: US 12,698,930 B2
(45) Date of Patent: Aug. 4, 2026

(54) COLD STORAGE MONITORING SYSTEM AND METHOD OF USE TO MONITOR TEMPERATURE AND UTILIZATION

(71) Applicant: POLYSENSE SOLUTIONS INC., Winnipeg (CA)

(72) Inventor: Matthew Daniel Brian Gale, Winnipeg (CA)

(73) Assignee: Polysense Solutions Inc., Winnipeg (CA)

( * ) Notice: Subject to any disclaimer, the term of this patent is extended or adjusted under 35 U.S.C. 154(b) by 111 days.

(21) Appl. No.: 18/613,990

(22) Filed: Mar. 22, 2024

(65) Prior Publication Data

US 2025/0297791 A1 Sep. 25, 2025

(51) Int. Cl.

| | |
|---|---|
| ***F25B 49/02*** | (2006.01) |
| ***F25B 49/00*** | (2006.01) |
| ***F25D 29/00*** | (2006.01) |

(52) U.S. Cl.

CPC ..... *F25B 49/005* (2013.01); *F25D 29/008* (2013.01); *F25B 2700/2104* (2013.01); *F25D 2700/02* (2013.01); *F25D 2700/121* (2013.01)

(58) Field of Classification Search

CPC ..... F25D 29/00; F25D 29/005; F25D 29/006; F25D 29/008; F25D 2700/02; F25D 2700/121

See application file for complete search history.

(56) References Cited

U.S. PATENT DOCUMENTS

| | | | | |
|---|---|---|---|---|
| 6,401,466 | B1 * | 6/2002 | Olsen | F25D 29/00 62/131 |
| 2018/0196592 | A1 * | 7/2018 | Oono | F25D 29/00 |
| 2019/0137169 | A1 * | 5/2019 | Hosokawa | H04M 1/72412 |
| 2021/0356202 | A1 * | 11/2021 | Han | F25D 29/006 |

* cited by examiner

*Primary Examiner* — Jonathan Bradford

(74) *Attorney, Agent, or Firm* — Ryan W. Dupuis; Kyle R. Satterthwaite; Ade & Company Inc.

(57) ABSTRACT

A monitoring system includes monitoring devices monitoring respective refrigerated storage units to measure internal temperature values and door status values representing the door being opened or closed. The devices periodically report the data to a computer server that stores the data in a database in respective database records associated with the monitoring devices respectively so that each database record includes a time series of the internal temperature values and a time series of door status values representing the door status over time. The server is able to generate reports which graphically represent both the internal temperature values and the door status values over a selected time range. User configurable alert criteria associated with the monitoring devices includes a temperature criterium, a door criterium, and a duration criterium for generating notifications when user attention is required.

20 Claims, 7 Drawing Sheets

COLD STORAGE MONITORING SYSTEM AND METHOD OF USE TO MONITOR TEMPERATURE AND UTILIZATION

FIELD OF THE INVENTION

The present invention relates to a monitoring system to compare monitored temperature and door status of a plurality of refrigerated storage units to alert criteria and to store the monitored data in a viewable database record.

BACKGROUND

In a laboratory, manufacturing, or research setting, there are typically many refrigerators and freezers that contain critical consumables, research materials and projects. It is important to record the history of the temperatures in these cold storage systems, and also know immediately when the temperature goes out of range so that the appropriate staff can intervene and ensure that whatever is stored is not compromised.

It is also important to know how often these freezers and fridges are accessed. In a large lab, a 'freezer farm' is common, and typically it is unknown how often these fridges and freezers are accessed, what is stored inside them, what the estimated value of the contents is, and how long the doors are opened for.

SUMMARY OF THE INVENTION

According to one embodiment, a monitoring device is provided in the form of a battery powered wireless sensor that utilizes four sensors. The four sensors are ambient temperature, ambient humidity, internal temperature, and a door open/close sensor. The monitoring device uses an energy efficient algorithm to monitor these sensor values and sends these values wirelessly to a computer server, either a remote server or a client hosted server. The client can then view a dashboard showing a graphical history of the sensor data along with other useful information that the user can manually store. This data is used to show the user how often the door is opened, and the average door open duration. The user can also view temperature data alarms and configure when they would like door and temperature alarms.

According to one aspect of the invention there is provided a monitoring system for monitoring a plurality of refrigerated storage units, each refrigerated storage unit including a compartment for receiving items to be refrigerated therein and a door for accessing the compartment, the system comprising:

a computer server;

a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

the computer server including a memory storing programming instructions thereon and a processor arranged to execute the programming instructions whereby the computer server is arranged to:

(i) store the values from the monitoring devices in a database comprising a database record associated with each monitoring device, in which each database record comprises (a) a time series of the internal temperature values representing the internal temperature over time, and (b) a time series of the door status values representing the door status over time; and (ii) generate a report for at least one selected database record over a selected time range which graphically represents both the internal temperature values and the door status values over the selected time range for said at least one selected database record.

The computer server may be further arranged to determine a maximum and/or minimum temperature over the selected time range and include said maximum and/or minimum temperature in the generated report.

The computer server may be further arranged to determine a door opening event duration between each door status value representing the door being opened and a subsequent door status value representing the door being closed that occurs during the selected time range.

For the database record associated with each monitoring device, the computer server may be further arranged to calculate an average duration of all door opening event durations that occur during the selected time range.

For the database record associated with each monitoring device, the computer server may be further arranged to determine a most recent door status value among the door status values representing the door being opened most recently during the selected time range. In this instance, the computer server may be further arranged to generate a listing of all database records organized in order of said most recent door status value for each database record.

Each monitoring device may further include an ambient sensor arranged to measure ambient condition values representative of ambient conditions in proximity to the associated refrigerated storage unit in which the controller of the monitoring device is further arranged to communicate the ambient condition values to the computer server periodically over time. The computer server may be further arranged to generate the report to include the ambient temperature values over the selected time range.

The computer server may be arranged to include a listing of the items within each refrigerated storage unit in the associated database record based on user input received from a user, in which said user input identifies the items.

The selected time range for generating reports is preferably selected based upon input from a user.

The internal temperature sensor may be arranged to measure the internal temperature value at a first periodic interval, while the controller may be arranged to communicate a plurality of the measured internal temperature values in packets at a second periodic interval that is equal to or greater in duration than at least two of the first periodic intervals.

The computer server is preferably further arranged to: (i) store alert criteria associated with each monitoring device selected from the list including a temperature criterium relating to the internal temperature, a door criterium relating to the door status, and a duration criterium relating to an elapsed time; (ii) compare at least one of the temperature values and the door status values to the alert criteria stored on the computer server; and (iii) generate a notification in response to the alert criteria being met; in which the alert criteria is programmably adjustable by a user.

The alert criteria for different database records associated with different monitoring devices are preferably different from one another.

The alert criteria may include (i) a combination of the duration criterium and the temperature criterium in order to generate a notification, (ii) a combination of the duration criterium and the door criterium in order to generate a notification; (iii) a combination of the temperature criterium and the door criterium wherein a change in the internal temperature value exceeding a threshold amount without a corresponding change in the door status value results in a notification being generated, and/or (iv) more than one temperature criterium associated with one of the database records in which said more than one temperature criteria are associated with different types of items stored in the compartment of the associated refrigerated storage unit. In the latter instance, the notification generated in response to the alert criteria being met preferably includes an indication of which types of items are associated with the alert criteria that was met.

The computer server may be further arranged to generate tiered notifications in response to the alert condition being met, the tiered notifications including a first notification to a first designated recipient upon the alert criteria being met, and a second notification to a second designated recipient upon an elapsed duration following the first notification if the alert criteria continue to be met.

According to a second aspect of the present invention there is provided a monitoring system for monitoring a plurality of refrigerated storage units, each refrigerated storage unit including a compartment for receiving items to be refrigerated therein and a door for accessing the compartment, the system comprising:

a computer server;

a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

the computer server including a memory storing programming instructions thereon and a processor arranged to execute the programming instructions whereby the computer server is arranged to:

(i) record the values from the monitoring devices in a database comprising a database record associated with each monitoring device, in which each database record comprises (a) a time series of the internal temperature values representing the internal temperature over time, (b) a time series of the door status values representing the door status over time, and (c) alert criteria associated with the monitoring device selected from the list including a temperature criterium relating to the internal temperature, a door criterium relating to the door status, and a duration criterium relating to an elapsed time;

(ii) compare at least one of the temperature values and the door status values to the alert criteria stored on the computer server; and (iii) generate a notification if the alert criteria is met;

wherein the alert criteria are programmably adjustable by a user.

The programmably adjustable alert criteria preferably enables one or more of (i) the alert criteria for different database records associated with different monitoring devices being different from one another, (ii) the alert criteria including a combination of the temperature criterium and the duration criterium, (iii) the alert criteria including a combination of the door criterium and the duration criterium, and (iv) the alert criteria including more than one temperature criterium associated with at least one of the database records in which the temperature criteria are associated with different types of items stored in the compartment of the associated refrigerated storage unit.

According to another aspect of the present invention there is provided a method of monitoring a plurality of refrigerated storage units in which each refrigerated storage unit includes a compartment for receiving items to be refrigerated therein and a door for accessing the compartment, the method comprising:

providing a computer server;

providing a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

storing the values from the monitoring devices in a database on the computer server in which the database comprises a database record associated with each monitoring device and each database record comprises (a) a time series of the internal temperature values representing the internal temperature over time, and (b) a time series of the door status values representing the door status over time; and using the computer server, generating a report for at least one selected database record over a selected time range which graphically represents both the internal temperature values and the door status values over the selected time range for said at least one selected database record.

According a further aspect of the present invention there is provided a method of monitoring a plurality of refrigerated storage units in which each refrigerated storage unit includes a compartment for receiving items to be refrigerated therein and a door for accessing the compartment, the method comprising:

providing a computer server;

providing a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

storing the values from the monitoring devices in a database on the computer server in which the database comprises a database record associated with each monitoring device and each database record comprises (a) a time series of the internal temperature values representing the internal temperature over time, and (b) a time series of the door status values representing the door status over time;

storing alert criteria for each database record associated with the monitoring device, the alert criteria being programmably adjustable by a user and the alert criteria being selected from the list including a temperature criterium relating to the internal temperature, a door criterium relating to the door status, and a duration criterium relating to an elapsed time;

comparing at least one of the temperature values and the door status values to the alert criteria stored on the computer server; and generating a notification if the alert criteria is met.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
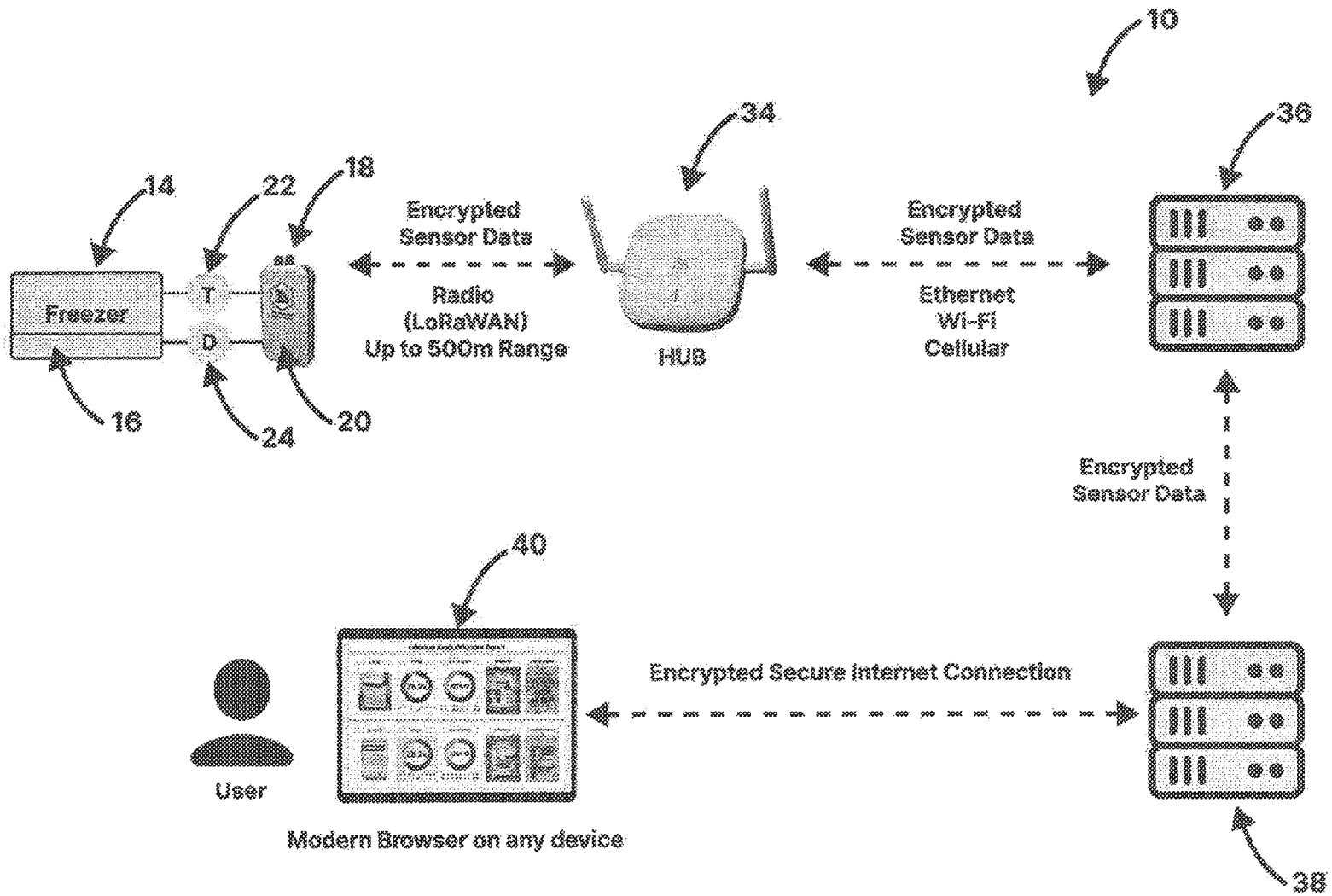
FIG. 1 is a schematic representation of the monitoring system for use in monitoring a plurality of refrigeration storage units.

Referring to the accompanying figures, there is illustrated a monitoring system generally indicated by reference numeral 10. The monitoring system is intended for monitoring a plurality of refrigerated storage units 12, for example freezers for storing various items as contents therein. Each unit includes at least one compartment 14 receiving various contents therein and a door 16 operable between an opened state and a closed state to selectively provide access to the compartment to place items in or remove items from the compartment.

Figure 2:
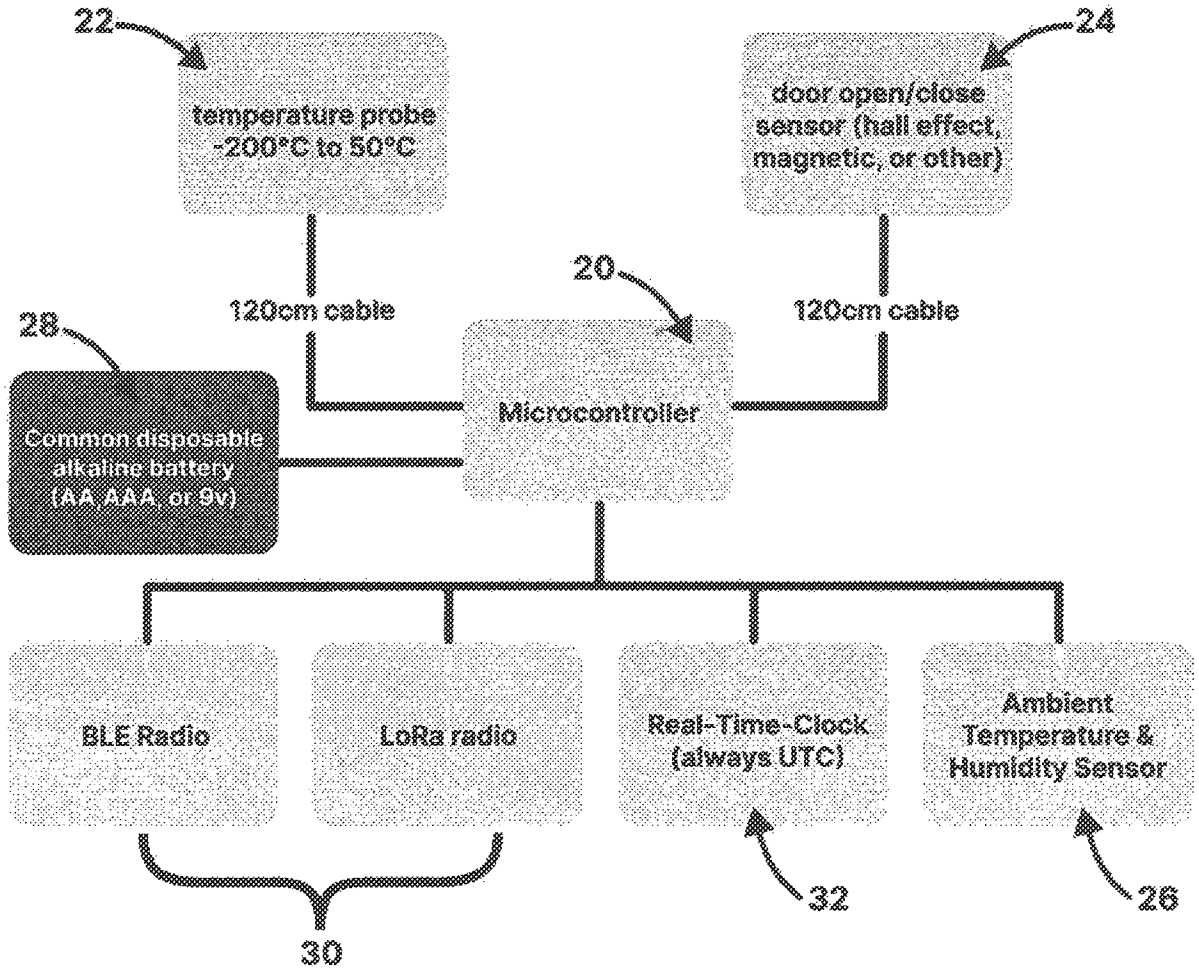
FIG. 2 is a schematic representation of one of the monitoring devices of the monitoring system of FIG. 1.

In a preferred arrangement of the system, the system includes a monitoring device 18 associated with each refrigerated storage unit 12 for monitoring that unit using a variety of sensors. As best shown in FIG. 2, each monitoring device 18 includes a controller 20 comprising a processor and a memory storing programming instructions thereon that are executed by the processor to perform the various functions described herein. The controller communicates with a temperature probe locating temperature sensor 22 thereon for placement inside the compartment 14 for measuring internal temperature values representative of the internal temperature within the compartment.

A door sensor 24 also communicates with the controller 20 and serves to record door status values in the form of opened door values representative of the door being opened and closed door values representative of the door being closed. More particularly, the door sensor 24 is a magnetic type switch including a magnet mounted on the door and a sensor on the door frame relying on hall effect to determine when the magnet is in proximity to the sensor indicative of the door being closed or to determine when the magnet is distal to the sensor indicative of the door being opened. The generated door status values recorded by the monitoring device for communication to the system may be indicative of the door being open or the door being closed, or may be indicative of the change of status of the door while opening or while closing.

The controller 20 of each monitoring device 18 also communicates with ambient condition sensors 26 which measure ambient temperature and humidity in proximity to the respective storage unit. The ambient condition sensors 26 generate ambient temperature values indicative of the ambient temperature and ambient humidity values indicative of ambient humidity for reporting back to the system along with the internal temperature values and the door status values.

Each monitoring device 18 also includes its own internal battery 28, for example, disposable batteries which are replaceable as required.

One or more communications antennas 30 are also provided in operative connection to the controller 20 for communicating with other equipment using various wireless signals such as radio signals and the like.

A real-time clock 32 tracks the time and date of the recorded values and the duration between measured values or changes in the measured values.

In the illustrated embodiment, a plurality of the monitoring devices 18 communicate their respective measured and recorded values back to a computer server of the system through an intermediate hub 34 which may assist the individual controllers 20 of the monitoring devices 18 in providing some of their controller function. The hub 34 thus act as an intermediate controller which assist in relaying data to the computer server for subsequent processing and analysis.

In the illustrated embodiment, the computer server includes a combination of (i) a local server 36 within the general environment of the monitoring devices 18 and the respective refrigerated storage units 12, and (ii) a remote central server 38. Each of the local server 36 and the remote server 38 may comprise one or more computers at one location or at distributed locations to collectively provide the function of an overall computer server as described herein. Typically, at each client location locating a plurality of refrigerated storage units 12, a local server is provided for recording all of the measured data from the monitoring devices 18 and for performing some degree of processing or analysis of the data for reporting to the client. A single central remote server 38 typically communicates with a plurality of different local client servers 36 at respective client locations to provide a common function to all of the local client servers in additional to recording data and processing data so that the data is accessible in the form of reports that can be accessed and viewed by clients on their own respective user computer devices 40. The remote server 38 communicates with the local servers 36 over a communications network such as the Internet. Likewise individual user computer devices 40, for example personal computers including laptops, tablets, smart phones and the like, communicate with the remote server 38 over a communications network such as the Internet. The user computer devices 40 can also communicate over a local area network with the local server 36 when being used at the client location.

The local servers 36 and the remote server 38 may have similar functions in communicating with the monitoring devices 18 directly or indirectly to acquire the measured data therefrom and store the data in a database including a database record associated with each refrigerated storage unit 12 in which the database records for all refrigeration units at one client location are organized in a respective client data set accessible by the client associated with that location.

The data record for each refrigerated storage unit includes an internal temperature field in which all of the internal temperature values recorded over time are stored as a time series of internal temperature values representative of the internal temperature varying over time.

Similarly, the data record for each unit includes an ambient temperature field and an ambient humidity field in which all of the ambient temperature values and the ambient humidity values recorded over time are similarly stored as a respective time series set of values representative of the ambient temperature and the ambient humidity varying over time.

The data record for each unit also includes a door status field in which all of the door status values recorded over time are stored as a time series of door status values representative of the door being opened or closed at specific points in time over the operating duration of the system. A door opening event duration is also calculated as the elapsed duration between each change of status of the door from closed to opened until the next change of status of the door from opened to closed.

Each database record also includes a contents field in which user input identifying individual items or the category or type of items being stored can be input by the user and stored in the database record to identify the contents of the refrigerated storage unit associated with that database record.

The database also stores various alert criteria which are customizable and programmably adjustable or configurable by the user so that different alert criteria can be stored in association with each different monitoring device 18. The alert criteria includes various types of temperature thresholds identified as temperature criteria, various door status conditions that can be met and which are identified as door criteria, and various elapsed time or duration thresholds for certain other conditions to be met which are referred to herein as duration criteria.

On a repeating and periodic basis, the computer server (which may include functions of the remote server 38, the local server 36, the intermediate controller 34, or portions of the individual controllers 20 of the monitoring devices 18) compares the measured values by the monitoring devices to the alert criteria associated with the database record of the corresponding monitoring device 18 to determine if an alert condition exists for which the user or client should be notified.

Examples of alert criteria include (i) the door status values indicating that a door has been opened for a duration that exceeds a duration threshold, (ii) a temperature that traverses a temperature limit or threshold for a duration that exceeds a duration threshold, (iii) a temperature that traverses a temperature limit or threshold regardless of the duration, (iv) a temperature change that is independent of a change in the door status, (v) a temperature change that exceeds a temperature threshold and that is independent of a change in door status, (vi) a temperature traversing a temperature threshold independent of a change in door status, (vii) a temperature that exceeds a temperature threshold after a door opening event but which does not return below the temperature threshold within a prescribed duration, etc.

When the database record includes a field identifying different contents for a particular refrigerated storage unit, and the user has identified various contents by input, the alert criteria for each database record associated with a respective storage unit can also include individually configurable temperature thresholds associated with each category or type of item being stored, and a configurable duration threshold associated with each of those individual temperature thresholds. Accordingly an alert condition can be determined for an individual item within the storage unit based on a combination of temperature and duration thresholds being met for that item such that the associated item or type of items is deemed to be compromised, while remaining items may not be deemed compromised.

An additional field within the database record can relate to identification of compromised items or contents. The database record will identify these contents which are deemed compromised automatically in response to an alert condition being generated in association with those contents.

Each database record associated with a respective storage unit also includes various fields for storing calculated statistical values used in generating reports for display to the client or user. The computer server in this instance may calculate various values such as an average temperature, a maximum temperature, and a minimum temperature over any time range that is selected among the time series internal temperature values. Likewise, the computer server may calculate the duration of each door opening event, the average duration of all door opening events within a selected time range and the most recent door opening event among all door opening events within a selected time range.

A user interface is provided on the user device 40 for communication with the software on the computer servers to enable the user to input any data relating to (i) contents of individual storage units 12, (ii) any selected criteria associated with individual contents or individual storage units within the client system, and (iii) any selected time ranges for which reports are to be generated for display to the user.

Once the system has been set up so that the monitoring devices 18 communicate through an intermediate controller 34 to the local server 36 and/or the remote server 38 of the overall computer server, normal operation of the system begins with the monitoring devices 18 actively monitoring temperature values, door status values, and ambient condition values for each of the refrigerated storage units 12 being monitored by the respective monitoring devices 18.

Figure 3:
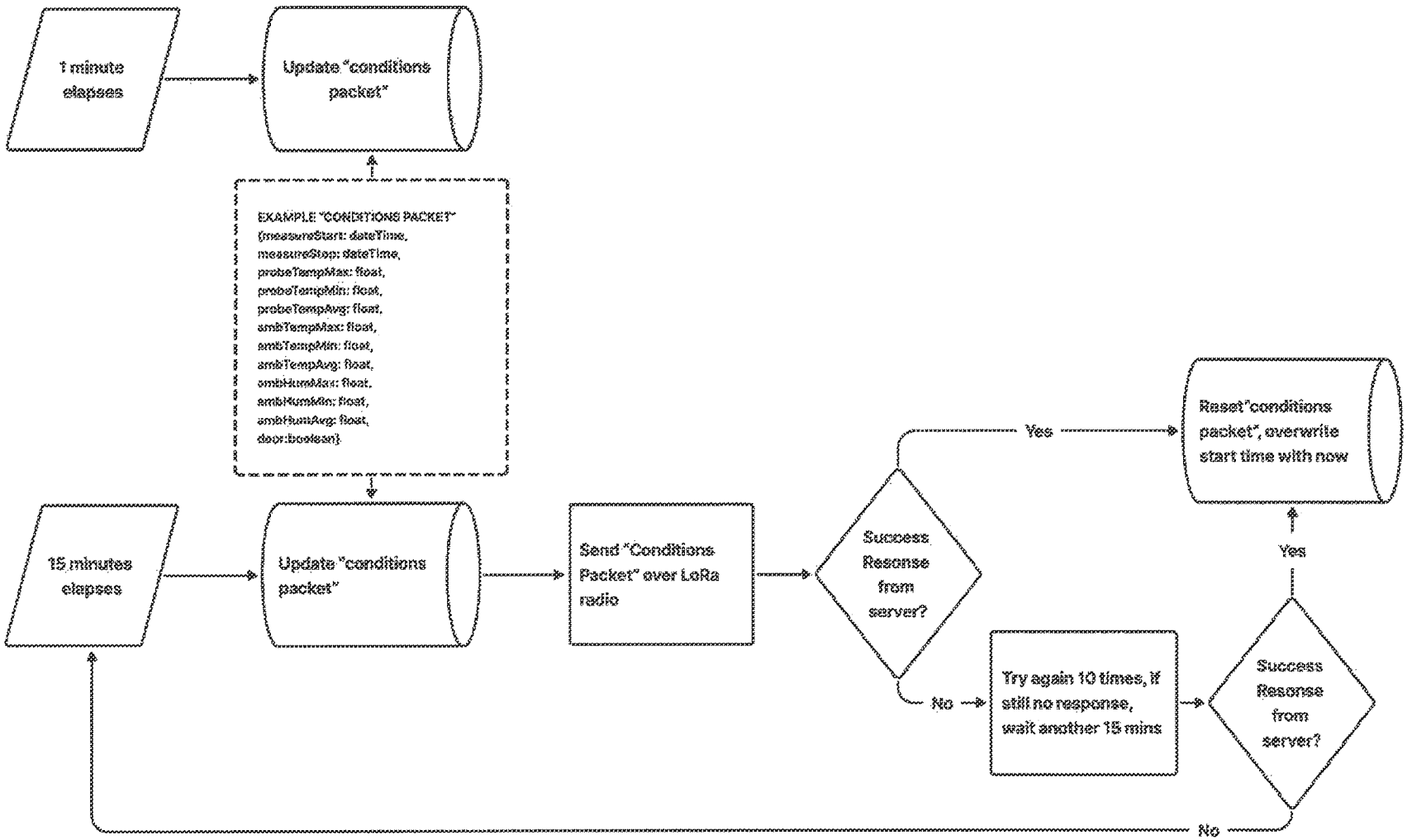
FIG. 3 is a flow chart representing the reporting of temperature data from the monitoring device to a server of the monitoring system of FIG. 1.

With regard to monitoring the internal temperature values as shown in FIG. 3, the controller 20 of each monitoring device 18 periodically samples the temperature sensor at a first periodic interval for example 1 minute between samplings, and gathers the collected internal temperature values into a packet on the controller 20. At a second periodic interval which is many times greater than the first periodic interval, for example at a 15 minute interval, the controller 26 transmits the updated packet wirelessly through the hub 34 to the local server 36. Communication to the hub 34 is accomplished using a radio signal, for example LoRa described elsewhere herein. If confirmation that the packet has been received by the local server is in turn received by the controller 20 of the monitoring device, a new cycle begins in collecting data in a new packet. Otherwise, the controller continues to attempt to communicate the packet through the hub 34 to the local server at periodic intervals. After a prescribed number of unsuccessful attempts, the controller 20 will abandon further communication attempts and then merely restart a new packet of collected internal temperature values to be subsequently transmitted.

Figure 4:
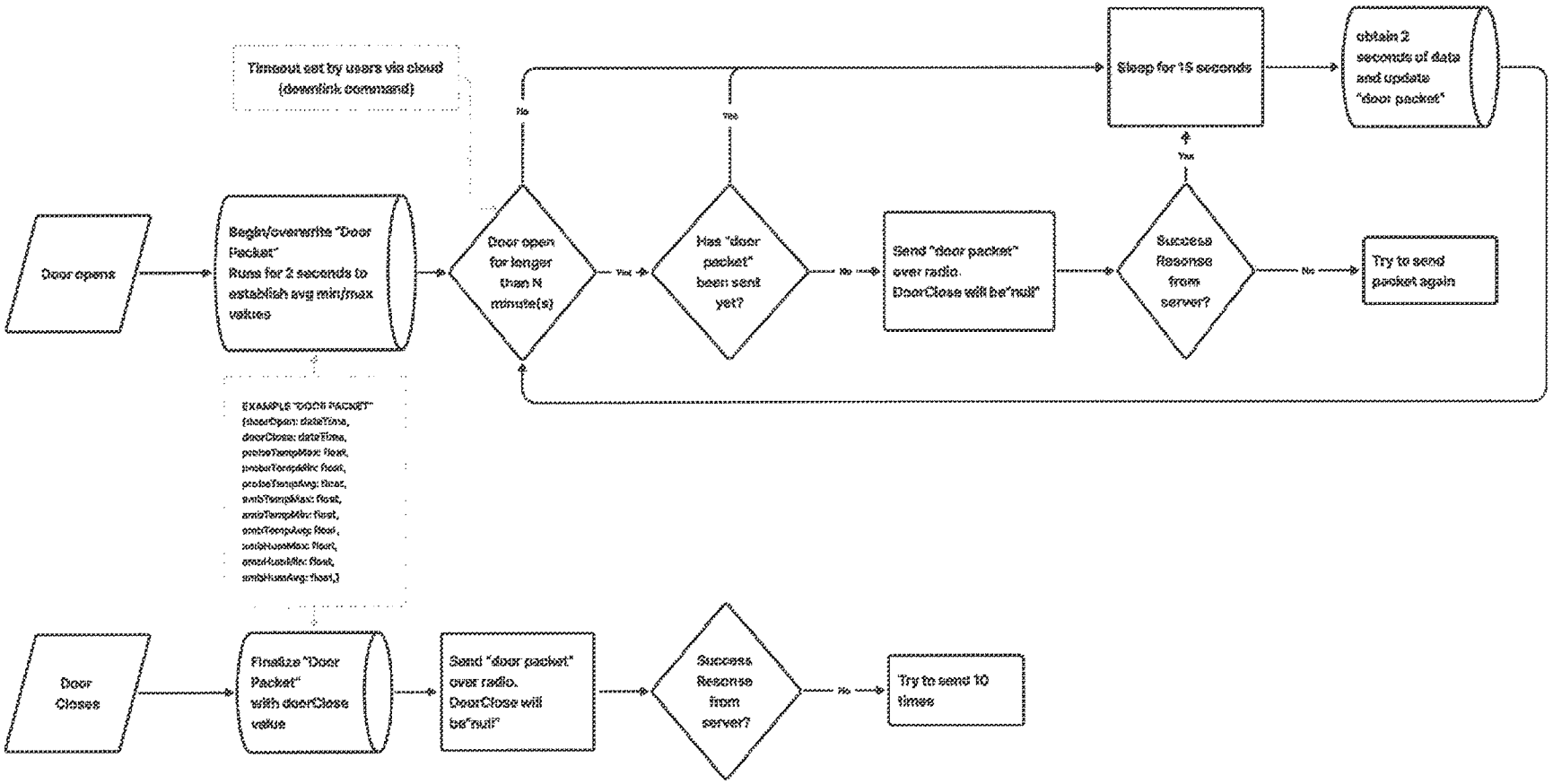
FIG. 4 is a flow chart representing the reporting of door status data from the monitoring device to a server of the monitoring system of FIG. 1.

With regard to door status values as shown in FIG. 4, upon receipt of the door status values indicative of the door being opened, the controller will start a new packet of data to report door status values. Once a new packet has started as a result of the first door criteria being met, the controller 20 monitors if the door has been opened for a duration that exceeds a duration threshold. If the duration threshold has not been met, the controller waits for an elapsed period of time, updates the packet that the door remains open for the elapsed time and then checks again that the door remains open. Once the duration threshold has been met, the controller attempts to communicate the packet of information relating to the door being opened to the server. The system continues updating the packet as each elapsed duration expires. Further, once the monitored door status value indicates that the door has been closed, the packet is likewise updated and transmitted to the server. The controller continues to attempt to transmit the packet of door status values at periodic intervals until confirmation has been received.

In response to a user with their own respective user computer device 40 accessing the servers, the servers can receive various input from the user with respect to generating reports according to selected parameters. The reports can be generated according to a time range selection input directly by the user or prescribed by various user selections. In response to a user selected time range, the server will generate a report for one or more database records associated with respective storage units 12. As shown in sample dashboard views in FIGS. 5 and 6, for the selected time range, the server can generate a graphical display 50 in which the varying temperature values are displayed over time together with changes in the door status value representing the door being opened and the door being closed. The ambient conditions can also be displayed over the same time range within the same graphical format. Additional data can be acquired by user selection to display the duration of each door opening event. Differing colours or other suitable indicia 52 can also be used to distinguish which portions of the varying temperature values represent temperature values measured while the door was opened versus while the door was closed. The user can reconfigure the selected time range at any time through a selection icon 54 and the graphical display will regenerate with data from the selected time range.

For each selected time range, the server will also calculate relevant statistics of interest to the user which are displayed in one or more tiles 56 on the same dashboard view with the graph representing the temperature values and door status values changing over time. Temperature statistics include the average temperature over the selected time range, the minimum temperature over the selected time range, and the maximum temperature over the selected time range. Door statistics include statistics related to the door opening events such as the total number of door opening events over the selected time range, the longest door opening event duration, the minimum door opening event duration, the average door opening event duration, and the most recent door opening event over the selected time range. The statistics are displayed in lists or tiles 56 adjacent to the graphical temperature and door status display.

The dashboard view also includes a contents list or contents tile 58 that identifies the contents or category type of contents for the respective storage unit with which the report is associated. User configurable criteria associated with the contents can also be accessed or displayed in the dashboard view.

The dashboard view may also include a maintenance list or tile 60 of maintenance services to be performed or which have been performed along with tracking of relevant timelines for performing service.

Figure 5:
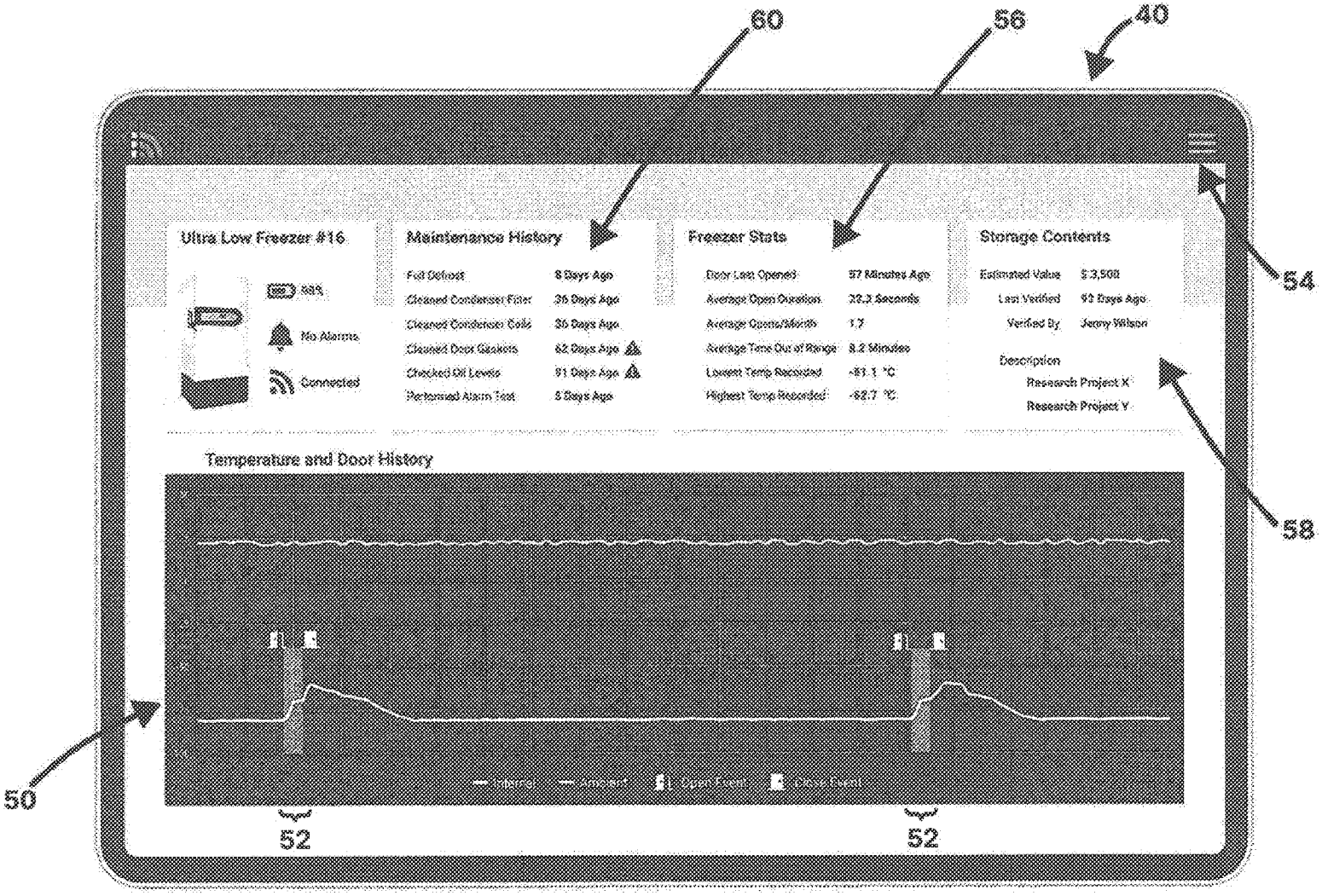
FIGS. 5 and 6 are illustrations of exemplary reports generated by the monitoring system of FIG. 1 for display on a user computer device.
Figure 6:
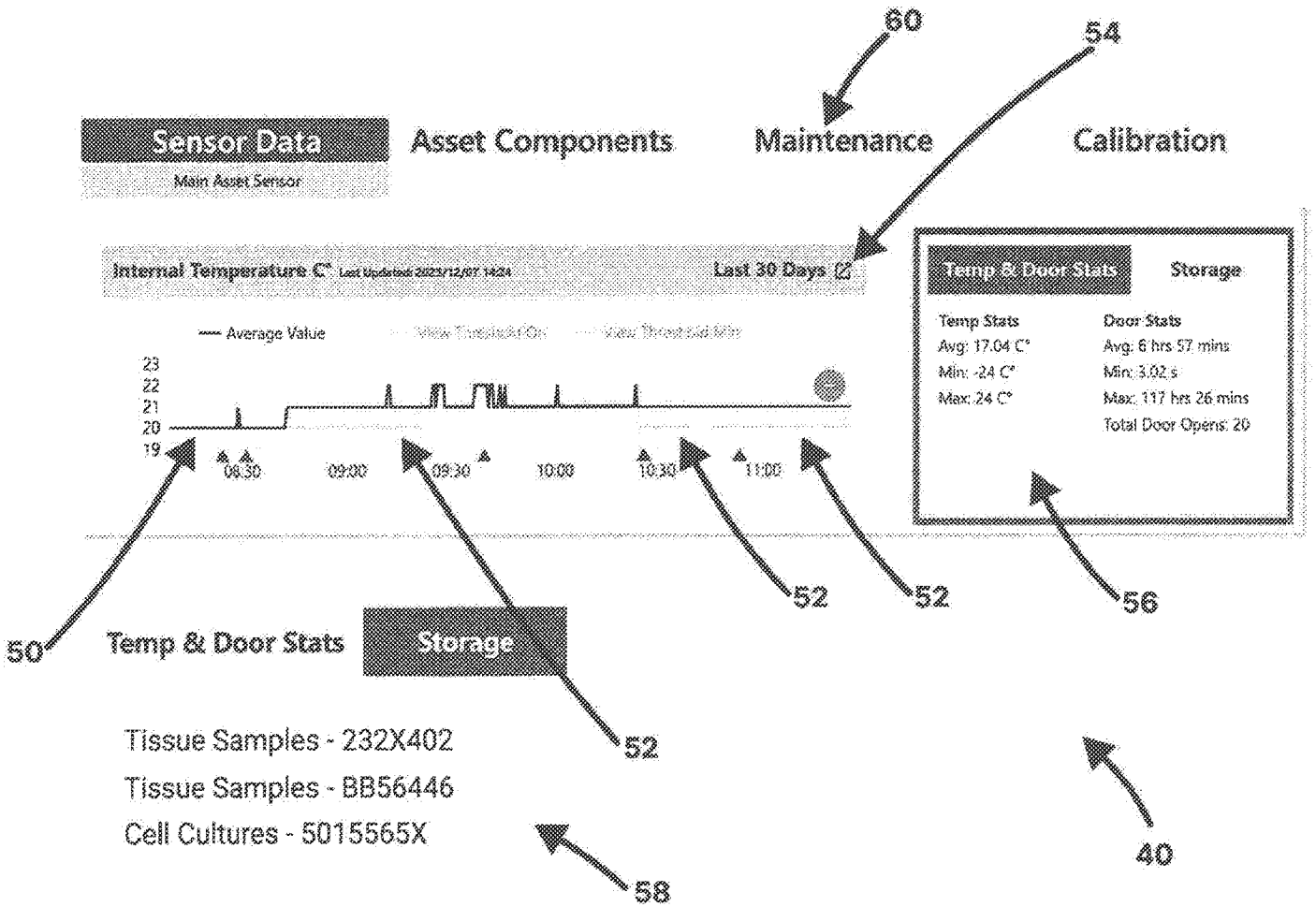

While FIGS. 5 and 6 represent a generated report for an individual storage unit having a respective monitoring device 18 associated therewith, reports can also be generated in a dashboard view which include individual tiles in which each tile includes a summary of information associated with one respective refrigerated storage unit so that all the tiles for all units can be viewed on a common page or a scrollable page in a list or grid view. Each tile associated with a respective storage unit 12 can display the relevant calculated statistics and any other relevant information such as the status of any alarms or notification criteria which have been met.

The server is also able to generate other reports based on the database records such as presenting a list of the database records which have been ranked by any of the data fields noted above. In one instance a listing of all storage units 12 can be generated which are ranked in order of the longest duration since the last door opening event, that is by the most recent door opening event. The database records can also be ranked according to the number of openings over a selected time range. Other similar statistics can be used for ranking the database records which provide the user with an indication of usage of the multiple storage units 12 relative to one another.

The database records can also be ranked in a report according to the contents or alarms being generated if desired. The contents can also be ranked by various temperature statistics. Ranking the database records according to maintenance history can also provide an indication as to which storage units are overdue for maintenance for example.

Figure 7:
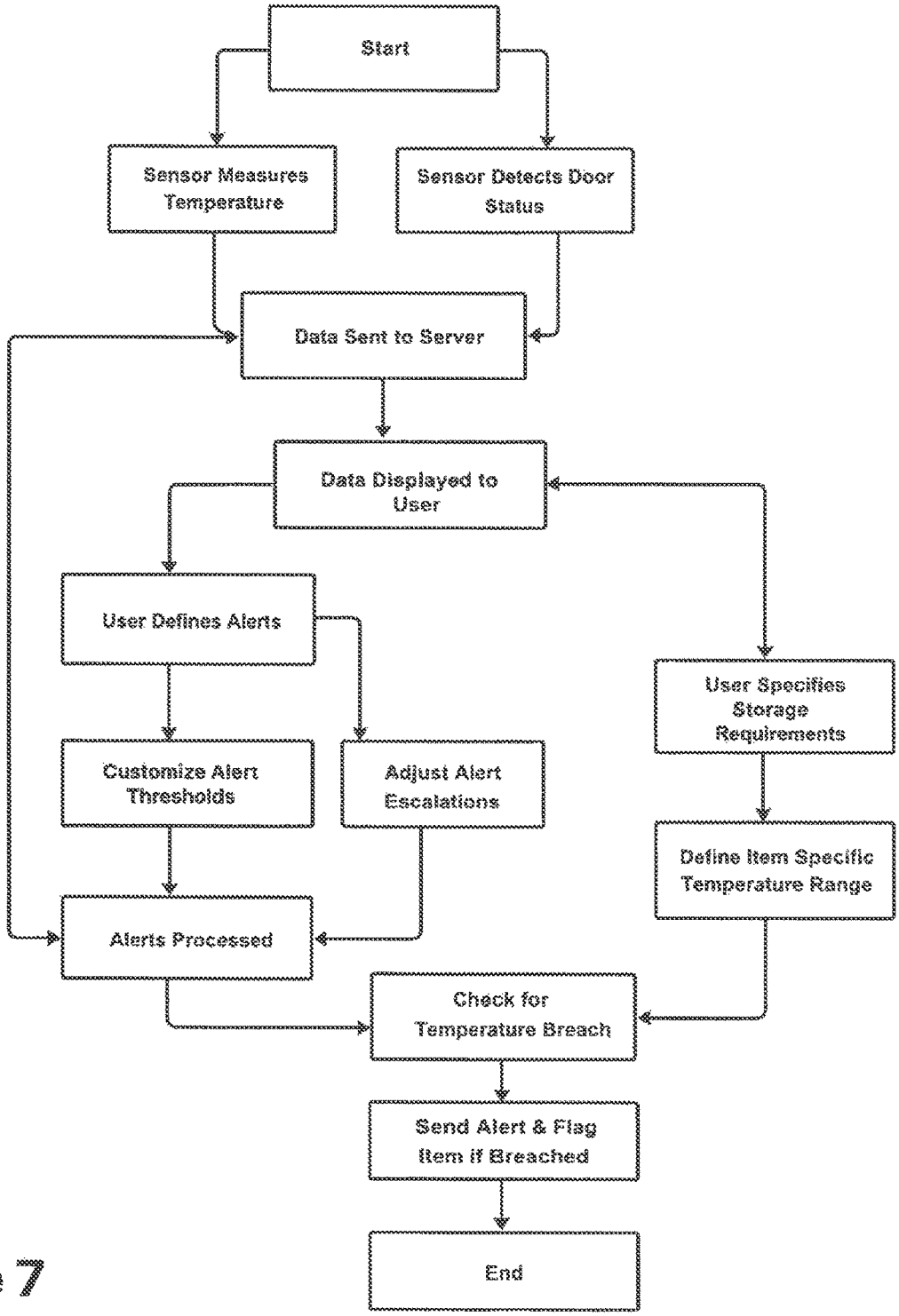
FIG. 7 is a flow chart representing various operations of the monitoring system of FIG. 1.

Turning now to FIG. 7, a flow chart is presented which describes general use and operation of the monitoring system 10. The system starts by activating the sensors to begin monitoring various temperature values and door status values as described above such that the acquired data can be communicated to the server on an ongoing basis. When the user interacts with the server through their own user computer device 40, various reports or data can be displayed to the user based upon the acquired measured values and the user inputs such as the selected time range. For each of the database records created by the system, the user can specify specific storage requirements such as the temperature threshold associated with one or more items within each storage unit and corresponding duration thresholds based on the ability of the different contents to withstand different temporary changes in temperature. The input thresholds define various alert criteria which are subsequently used by the system in determining if any alert conditions exist.

The user can also interact with the system to define the form of the alerts such as the manner of notification and the recipients of any alert notifications once an alert has been determined. In addition to customized alert thresholds, the system also allows programming of a set of tiered alerts. This includes a first tier alert having an associated first list of notification recipients, a second tier alert having an associated second list of notification recipients, and optional third and/or fourth tier alerts having associated third and fourth lists of notification recipients. A prescribed notification interval or duration between each tier of notifications is also configurable by the user. In response to determination of an alert condition as a result of one of the alert criteria being met, the system will immediately send the alert notification to the first recipient(s) according to the first tier alert. If the alert condition persists after an elapsed duration, the system will send second notifications to the recipients of the second tier alert. After further elapsed durations, each subsequent tier will be similarly notified. The number of tiers can also be configured by the user. At any time, if the alert condition is corrected, then the system will cease sending notifications. Likewise, if a recipient of an alert notification notifies the system through user input that they are attending to the alert condition, the system will pause further alerts for a prescribed duration before resuming the tiered alert notifications if the alert condition has not been corrected.

In addition to sending the notifications when an alert condition has been determined as a result of the alert criteria being met, the server will also identify which contents associated with which storage unit had a threshold or associated criteria that was met and was the cause the alert condition. These associated contents will then be deemed compromised within the respective database record. The contents will remain flagged as compromised until a user has an opportunity to inspect the contents and determine (i) if the contents have been spoiled so that they are disposed and removed from the contents list by user input, or (ii) if the contents have not been spoiled and the flag can be cleared so that the item is removed from the compromised list of the database record in response to user input.

As described herein, the monitoring system 10 generally includes the following three main components: (i) the monitoring devices which measure ambient temperature, ambient humidity, internal temperature, and door open/close sensor, (ii) controller algorithms that allow efficient monitoring and reporting of the monitored data, and (iii) software on the server which gathers the data, generates reports on the data, and compares the data to alert criteria for effectively communicating the data, for example through web browser based software dashboards that display the data to the user and allow the user to input their own data.

The monitoring devices can last up to 1 year on AA alkaline batteries due to their efficient algorithm and wireless protocol. In a typical laboratory, hospital, or manufacturing environment, assets are spread out from each other such that the usage of wireless communication protocols like Bluetooth, Zigbee or Wi-Fi posses many problems. Bluetooth and ZigBee cannot communicate long distances. Wi-Fi can communicate longer distances but still has dead zones in large facilities. Not only does Wi-Fi have dead zones, but it is an Information Technology professional's nightmare to have hundreds or even thousands of Wi-Fi connected devices that can be backdoors or vulnerabilities to their network infrastructure. Because of these reasons, the monitoring system preferably uses LoRa technology. LoRa (from "long range") is a physical proprietary radio communication technique. It is based on spread spectrum modulation techniques derived from chirp spread spectrum (CSS) technology. It was developed by Cycleo (U.S. Pat. No. 9,647,718-B2), a company of Grenoble, France, later acquired by Semtech. This LoRa radio communication allows hundreds of devices to communicate in a facility over long distances, with only one internet connected device, which is the head node or gateway. It also is very low power consuming while transmitting this data.

Each monitoring device measures internal temperature of an associated freezer or refrigerator using a temperature probe. The probe can be inserted into the unit by the auxiliary port meant for these remote probes within the refrigerated storage unit 12, or the probe can be passed through the door seal. A temperature reading may be taken every 30 seconds and stored in memory. Every 10 minutes this payload can be sent to the servers. If communication is down the monitoring device can store up to 48 hours of data before it starts over.

The controllers of the monitoring devices and any intermediate controllers for communicating data to the servers first transmit data over LoRaWAN to a third party service called 'The Things Stack'. The Things Stack utilizes a webhook that converts the LoRaWAN packet into JSON, then uses a HTTPS POST request to send this JSON formatted data to the central server. This POST request is authenticated with an authorization token that is generated by a token system on the central server. When the central server receives this POST request, it will run store the sensor data in a database. The user can then access this data via software accessed on a web browser, and the user can view how often their fridge/freezers are accessed, record maintenance, see how long the doors are opened for on average, and a temperature and humidity history.

Using this system, various reports can be generated over user selected time frames that display a history of internal temperatures and door opening events in addition to calculated temperature and door statistics over the user selected time range. This information helps users understand how often the freezer or refrigerator is utilized. Sometimes freezers can go months or years without being accessed in a research setting. This helps understand if the storage unit is used hourly, daily, monthly or longer. The data also allows the user to understand if there is a maintenance issue with a refrigerated storage unit, or if the unit is merely being used infrequently. In prior art systems using temperature alarms without any associated recorded data relating to temperature history and associated door status, a manager of a large number of freezers cannot distinguish when a temperature threshold alarm is triggered if it is because someone has merely just accessed the freezer or if the freezer compressor is beginning to fail. The combined temperature and door history assist in diagnosing temperature changes in relation to door opening events.

The use of a database having a database record associated with each refrigerated storage unit also enables recording of what is stored in each unit so that users can look for specific stored contents and their whereabouts without having to open the storage units that lets warm air inside. Users can also set individual thresholds on items so that they can be flagged as potentially compromised. For example, users can set individual temperature thresholds on items stored in the unit. If the sensors measure this temperature, it will flag the item is potentially compromised and allow the user to decide if it is physically compromised or not.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A monitoring system for monitoring a plurality of refrigerated storage units, each refrigerated storage unit including a compartment for receiving items to be refrigerated therein and a door for accessing the compartment, the system comprising:

a computer server;

a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

the computer server including a memory storing programming instructions thereon and a processor arranged to execute the programming instructions whereby the computer server is arranged to:

(i) store the values from the monitoring devices in a database comprising a database record associated with each monitoring device, in which each database record comprises (a) a time series of the internal temperature values representing the internal temperature over time, and (b) a time series of the door status values representing the door status over time; and (ii) for said at least one selected database record, generate a report for at least one selected database record over a selected time range which (a) graphically represents variation of the internal temperature values over the selected time range and (b) distinguishes which portions of the internal temperatures over the selected time range were measured while the door status values correspond to the door being open and which portions of the internal temperatures over the selected time range were measured while the door status values correspond to the door being closed.

2. The system according to claim 1 wherein the computer server is further arranged to determine a maximum and/or minimum temperature over the selected time range and include said maximum and/or minimum temperature in the generated report.

3. The system according to claim 1 wherein the computer server is further arranged to determine a door opening event duration between each door status value representing the door being opened and a subsequent door status value representing the door being closed that occurs during the selected time range.

4. The system according to claim 3 wherein, for the database record associated with each monitoring device, the computer server is further arranged to calculate an average duration of all door opening event durations that occur during the selected time range.

5. The system according to claim 1 wherein, for the database record associated with each monitoring device, the computer server is further arranged to determine a most recent door status value among the door status values representing the door being opened most recently during the selected time range.

6. The system according to claim 5 wherein the computer server is further arranged to generate a listing of all database records organized in order of said most recent door status value for each database record.

7. The system according to claim 1 wherein each monitoring device further includes an ambient sensor arranged to measure ambient condition values representative of ambient conditions in proximity to the associated refrigerated storage unit in which the controller of the monitoring device is further arranged to communicate the ambient condition values to the computer server periodically over time, and wherein the computer server is further arranged to generate the report to include the ambient condition values over the selected time range.

8. The system according to claim 1 wherein the computer server is arranged to include a listing of the items within each refrigerated storage unit in the associated database record based on user input received from a user, in which said user input identifies the items.

9. The system according to claim 1 wherein the selected time range is selected based upon input from a user.

10. The system according to claim 1 wherein the internal temperature sensor is arranged to measure the internal temperature value at a first periodic interval, and wherein the controller is arranged to communicate a plurality of the measured internal temperature values in packets at a second periodic interval that is equal to or greater in duration than at least two of the first periodic intervals.

11. The system according to claim 1 wherein the computer server is further arranged to:

(i) store alert criteria associated with each monitoring device selected from the list including a temperature criterium relating to the internal temperature, a door criterium relating to the door status, and a duration criterium relating to an elapsed time;

(ii) compare at least one of the temperature values and the door status values to the alert criteria stored on the computer server; and (iii) generate a notification in response to the alert criteria being met;

wherein the alert criteria are programmably adjustable by a user.

12. The system according to claim 11 wherein the alert criteria for different database records associated with different monitoring devices are different from one another.

13. The system according to claim 11 wherein the alert criteria include a combination of the duration criterium and the temperature criterium in order to generate a notification.

14. The system according to claim 11 wherein the alert criteria include more than one temperature criterium associated with one of the database records, and wherein said more than one temperature criteria are associated with different types of items stored in the compartment of the associated refrigerated storage unit.

15. The system according to claim 14 wherein the notification generated in response to the alert criteria being met includes an indication of which types of items are associated with the alert criteria that was met.

16. The system according to claim 11 wherein the alert criteria include a combination of the duration criterium and the door criterium in order to generate a notification.

17. The system according to claim 11 wherein the computer server is arranged to generate tiered notifications in response to the alert condition being met, the tiered notifications including a first notification to a first designated recipient upon the alert criteria being met, and a second notification to a second designated recipient upon an elapsed duration following the first notification if the alert criteria continue to be met.

18. A monitoring system for monitoring a plurality of refrigerated storage units, each refrigerated storage unit including a compartment for receiving items to be refrigerated therein and a door for accessing the compartment, the system comprising:

a computer server;

a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

the computer server including a memory storing programming instructions thereon and a processor arranged to execute the programming instructions whereby the computer server is arranged to:

(i) store the values from the monitoring devices in a database comprising a database record associated with each monitoring device, in which each database record comprises (a) a time series of the internal temperature values representing the internal temperature over time, (b) a time series of the door status values representing the door status over time, and (c) alert criteria associated with the monitoring devices including a temperature criterium relating to the internal temperature, a door criterium relating to the door status, and a duration criterium relating to an elapsed time;

(ii) compare the temperature values and the door status values to the alert criteria stored on the computer server; and (iii) generate a notification in response to a combination of the temperature criterium, the door criterium, and the duration criterium being met;

wherein the alert criteria are programmably adjustable by a user.

19. The system according to claim 18 wherein a change in the internal temperature value exceeding a threshold amount together with the door status value corresponding to the door being closed results in the notification being generated while a change in the internal temperature value exceeding the threshold amount together with the door status value corresponding to the door being open does not result in the notification being generated.

20. A monitoring system for monitoring a plurality of refrigerated storage units, each refrigerated storage unit including a compartment for receiving items to be refrigerated therein and a door for accessing the compartment, the system comprising:

a computer server;

a plurality of monitoring devices arranged to be associated with the refrigerated storage units respectively, each monitoring device including (i) an internal temperature sensor arranged to measure an internal temperature value representing an internal temperature within the compartment of the associated refrigerated storage unit, (ii) a door sensor arranged to determine a door status value representing the door of the associated refrigerated storage unit being opened or closed, and (iii) a controller arranged to communicate the internal temperature values and the door status values to the computer server periodically over time;

the computer server including a memory storing programming instructions thereon and a processor arranged to execute the programming instructions whereby the computer server is arranged to:

(i) store the values from the monitoring devices in a database comprising a database record associated with each monitoring device;

wherein each database record comprises (a) a time series of the internal temperature values representing the internal temperature over time, (b) a time series of the door status values representing the door status over time, and (c) alert criteria associated with the monitoring devices including a temperature criteria relating to the internal temperature, and a door criterium relating to the door status; and wherein the temperature criteria of one of the database records associated with one of the refrigerated storage units comprises a plurality of different temperature criterium associated with different types of items stored in the compartment of said one of the associated refrigerated storage units;

(ii) compare the temperature values and the door values to the alert criteria stored on the computer server including the plurality of different temperature criterium associated with the different types of items stored in the compartment of said one of the associated refrigerated storage units; and (iii) generate a notification if the door values meet the door criterium and the temperature values meet any one of the different temperature criterium associated with the different types of items stored in the compartment of said one of the associated refrigerated storage units;

wherein the notification includes an indication of which of the different types of items stored in the compartment of said one of the associated refrigerated storage units had the associated temperature criterium met by the temperature values so as to result in the notification being generated.

* * * * *